United States Patent [19]

Dill

[11] Patent Number: 4,670,996

[45] Date of Patent: Jun. 9, 1987

[54] WOMEN'S SHOES WITH FLEXIBLE SPRING STEEL SHANKS FOR USE WITH REPLACEABLE HEELS OF DIFFERENT HEIGHT

[76] Inventor: Mary J. Dill, 1913 N. Connecticut, Royal Oak, Mich. 48073

[21] Appl. No.: 889,619

[22] Filed: Jul. 28, 1986

[51] Int. Cl.[4] ..... A43B 21/36; A43B 21/50; A43B 21/51

[52] U.S. Cl. ..... 36/42; 36/36 C; 36/36 R; 36/41

[58] Field of Search ..... 36/42, 36 R, 36 A, 36 B, 36/36 C, 41, 34 R, 39

[56] References Cited

U.S. PATENT DOCUMENTS

| | | | |
|---|---|---|---|
| 895,924 | 8/1908 | White | 36/36 C |
| 988,060 | 3/1911 | Andrews | 36/42 |
| 1,234,508 | 7/1917 | Sztari | 36/42 |
| 1,268,731 | 6/1918 | Kornstein | 36/42 |
| 1,369,529 | 2/1921 | Maloney | 36/42 |
| 1,383,436 | 7/1921 | Solarz | 36/42 |
| 1,516,384 | 11/1924 | Kamada | 36/42 |
| 1,563,970 | 12/1925 | Eichorn | 36/42 |
| 1,604,826 | 10/1926 | Hornicek | 36/42 |
| 1,673,452 | 6/1928 | Hegedus | 36/42 |
| 1,674,549 | 6/1928 | Hobert | 36/42 |
| 1,743,543 | 1/1930 | Gutierrez | 36/42 |
| 1,829,253 | 10/1931 | Zubia et al. | 36/42 |
| 1,832,744 | 11/1931 | Siegel | 36/42 |
| 1,948,967 | 2/1934 | Jassen | 36/42 |
| 2,258,265 | 10/1941 | Schwartz | 36/42 |
| 2,369,201 | 2/1945 | Anson | 36/36 R |
| 2,385,592 | 9/1945 | Walker | 36/42 |
| 2,435,723 | 2/1948 | Moffatt | 36/36 R |
| 2,439,310 | 4/1948 | Mancuso | 36/42 |
| 3,063,169 | 11/1962 | Cortina | 36/36 R |
| 3,266,177 | 8/1966 | Holden | 36/36 R |
| 3,432,945 | 3/1969 | Cesta | 36/36 R |
| 3,754,340 | 8/1973 | Pais | 36/42 |
| 3,797,136 | 3/1974 | Soleri | 36/42 |
| 4,416,072 | 11/1983 | Sarkissian | 36/42 |

FOREIGN PATENT DOCUMENTS

| | | | |
|---|---|---|---|
| 361929 | 10/1922 | Fed. Rep. of Germany | 36/36 R |
| 96256 | 6/1923 | Fed. Rep. of Germany | 36/42 |
| 506109 | 8/1930 | Fed. Rep. of Germany | 36/42 |
| 1293 | of 1905 | United Kingdom | 36/42 |
| 9854 | of 1914 | United Kingdom | 36/42 |
| 713290 | 8/1954 | United Kingdom | 36/42 |

*Primary Examiner*—Werner H. Schroeder
*Assistant Examiner*—Steven N. Meyers
*Attorney, Agent, or Firm*—Cullen, Sloman, Cantor, Grauer, Scott & Rutherford

[57] ABSTRACT

A women's shoe with flexible shank for use with replaceable heels of different height includes a sole with a forward support portion and a raised heel portion and an overlying insole. An elongated flexible spring steel shank is nested within a slot between the insole and sole and at one end anchored thereto. A high heel registers with the heel portion and interlocking fasteners upon the heel and heel portion upon limited rotation of the heel relative to the shoe removably anchors the heel upon the shoe. The heel upon limited angular rotation and disengagement of the fasteners is adapted for removal and replacement by a low heel having similar fasteners. The shank moves within the slot to compensate for the change in height. The interlocking fasteners include opposed interconnected lock segments and anchor flanges secured respectively to the heel and heel portion. An alignment pin in the heel projects into an alignment opening in the sole preventing relative rotation of the heel and heel portion to prevent disengagement of the segments and flanges.

16 Claims, 7 Drawing Figures

WOMEN'S SHOES WITH FLEXIBLE SPRING STEEL SHANKS FOR USE WITH REPLACEABLE HEELS OF DIFFERENT HEIGHT

FIELD OF THE INVENTION

The invention relates to women's shoes having a flexible spring steel shank nested between the sole and insole of the shoe for longitudinal movement relative thereto upon changing from a high heel to a low heel. Disengageable locking means are provided upon the heel portion of the shoe and upon a removable replaceable high heel for securing the heel thereon and for separating the heel and for replacement by a low heel.

BACKGROUND OF THE INVENTION

Heretofore, in shoes, including men's and women's shoes, various efforts have been made to provide a replaceable heel or a removable heel for the shoe, including ladies shoes and wherein various types of interlocking securing means are employed for removably anchoring the heel to the heel portion of the shoe. The problem with some of these interchangeable heel constructions has been the difficulty of providing interlocking fasteners which are easy to use without tools together with a locking means to prevent accidental separation of the heel from the shoe. Heretofore, in the prior art the primary objective was to replace a worn heel with a replacement heel, particularly adapted for men's shoes, though not limited thereto.

THE PRIOR ART

The following prior art patents are examples of interchangeable heels for shoes with various structures for anchoring the heel upon the shoe.

| Patent No. | Patent Date | Patentee |
|---|---|---|
| 895,924 | 8/11/08 | W. White |
| 988,060 | 3/28/11 | Louis Andrews |
| 1,234,508 | 7/24/17 | J. Sztari |
| 1,396,529 | 2/22/21 | W. A. Maloney |
| 1,383,436 | 7/5/21 | S. Solarz |
| 1,516,384 | 11/18/24 | R. R. Kamada |
| 1,563,970 | 12/1/25 | A. M. Eichorn |
| 1,673,452 | 6/12/28 | J. Hegedus |
| 1,674,549 | 6/19/28 | C. Hobert |
| 1,832,744 | 11/17/31 | M. Siegel |
| 1,948,967 | 2/27/34 | B. Jassen |
| 2,369,201 | 2/13/45 | G. Anson |
| 2,435,723 | 2/10/48 | R. J. Moffatt |
| 3,063,169 | 11/13/62 | A. Cortina |
| 3,266,177 | 8/16/66 | M. R. Holden |
| 3,432,945 | 3/18/69 | F. Cesta |

SUMMARY OF THE INVENTION

An important feature of the present invention is to provide a women's shoe with a flexible shank for use with replaceable heels of different height and wherein the flexible shank is so mounted between the sole and insole of the shoe as to permit relative adjustment thereof when the high heel is replaced by a low heel.

Another feature is to provide between the sole and insole of a women's shoe a centrally arranged elongated slot within which is positioned an elongated flexible spring steel shank which is anchored to the shoe at one end and wherein the slot is oversized in length to accommodate longitudinal adjustments of the shank with respect to the slot upon replacement of the high heel with a low heel.

An important feature includes in conjunction with such flexible shank, an improved interlocking means between the heel portion of the shoe and the top surface of the heel such that upon limited angular rotation of the heel with respect to the heel portion, there will be a sufficient interlock of the heel with respect to the heel portion as will firmly affix the heel thereto, together with a means for preventing such angular rotation between the parts as will prevent a disconnect of the heel from the shoe.

Another feature is to provide interlocking means between the heel portion of the shoe and the top of the heel which includes upon the heel portion and upon the heel respectively corresponding spaced arcuate lock segments and anchor flanges which upon assembly and relative rotation are suitably interlocked.

Another feature includes an alignment pin carried by the heel which projects within an alignment aperture in the sole to prevent accidental relative rotation of the heel with respect to the sole, thereby maintaining the interlock between the shoe and the heel.

As a further feature, the interlocking means between the heel portion of the shoe and the heel includes a heel anchor plate secured to the heel portion from which depend a series of arcuate outwardly directed spaced lock segments adapted for projection within correspondingly spaced arcuate apertures within the top surface of a heel, and which upon predetermined relative angular movement may be rotated into an interlock with corresponding undercut anchor flanges upon the heel for fixedly anchoring the heel to the shoe.

An important feature includes an alignment pin mounted upon the heel and spaced from the fastening means and normally maintained by a suitable anchor pin so as to project into an alignment aperture in the undersurface of the sole for preventing relative rotation of the heel with respect to the shoe thereby assuring that the heel remains in a locked position anchored to the undersurface thereof.

These and other objects and features will be seen from the following specification and claims in conjunction with the appended drawings.

THE DRAWINGS

It will be understood that the above drawings illustrate merely a preferred embodiment of the invention, and that other embodiments are contemplated within the scope of the claims hereafter set forth.

BRIEF DESCRIPTION OF AN EMBODIMENT OF THE INVENTION

Figure 1:
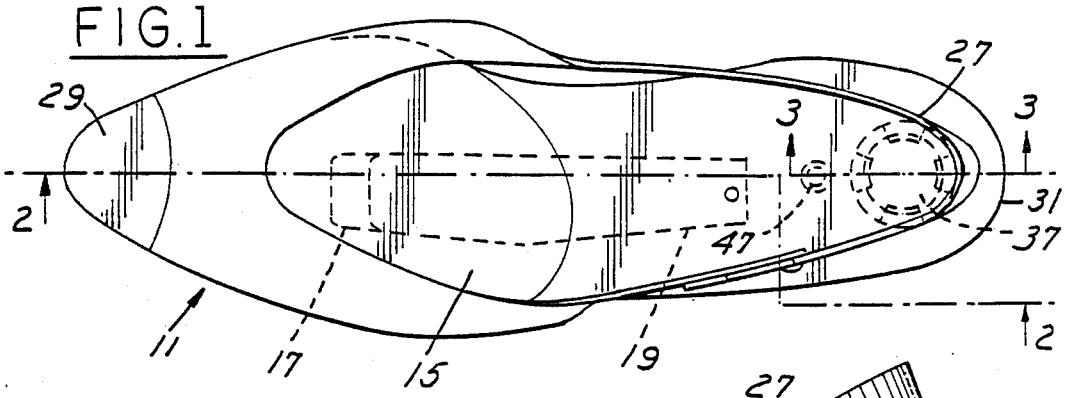
FIG. 1 is a plan view of a women's shoe of the strap type which incorporates the present flexible spring steel shank and removable heel.
Figure 2:
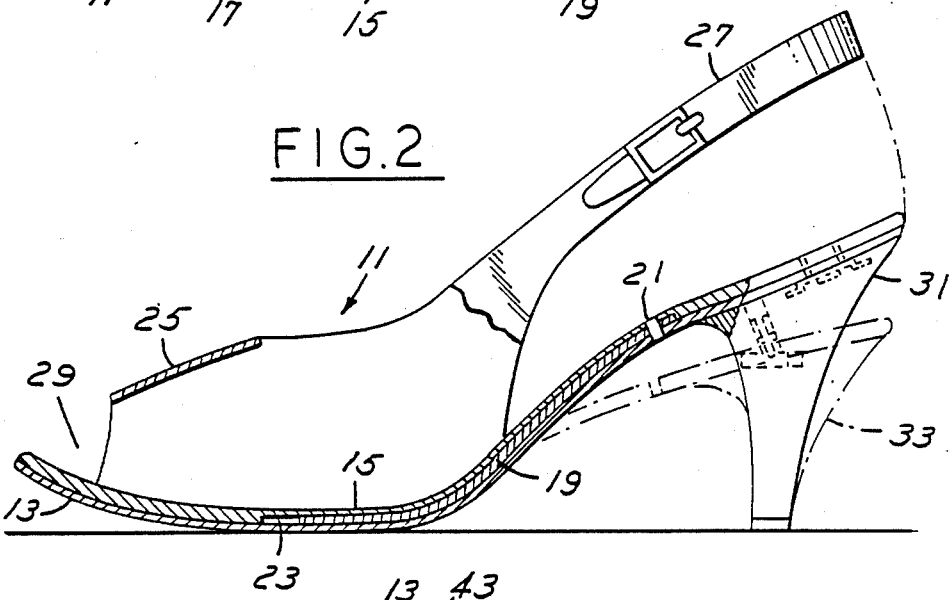
FIG. 2 is an elevational section taken in the direction of arrows 2—2 of FIG. 1, showing in dash lines a replacement heel.

Referring to the drawings, a women's shoe 11 is shown in FIGS. 1 and 2, having a removable heel 31 or 33, FIG. 2, and which includes sole 13 having a forward surface engaging portion or support portion and a raised heel portion 35. Insole 15 overlies sole 13 and is suitably sealed and secured thereto in a conventional manner.

Within the undersurface of insole 15 centrally thereof there is provided an elongated slot 17 normally closed by sole 13, and within which is positioned flexible spring steel shank 19. One end of the spring steel shank as for example the heel end is anchored to the sole and insole by the fastener or rivet 21, FIG. 2.

Central elongated slot 17 is oversized with respect to shank 19 as shown by the clearance 23. This is to accommodate longitudinal adjustment of the free end portion of shank 19 relative to the sole and insole when high heel 31 has been replaced by low heel 33.

In the illustrative embodiment, the shoe includes a strap 27, though under some conditions it could be a closed heel, and includes an open toe 29. In the illustrative embodiment, a relatively high heel 31 underlies the heel portion 35 or bottom of the shoe sole, FIG. 4, and is removably secured thereto.

Interlockable means are disclosed for removably securing heel 31 with respect to heel portion so that upon separation and disconnect of the interlock fastening mechanism, high heel 31 may be replaced by low heel 33, shown in dash lines in FIG. 2.

Figure 5:
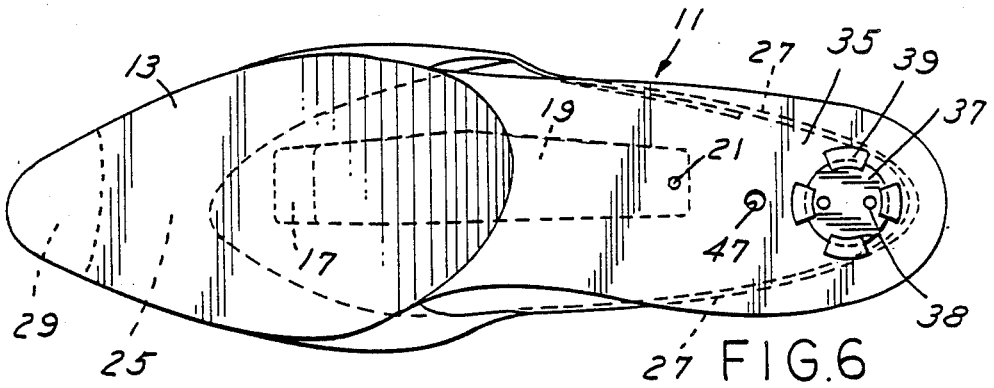
FIG. 5 is a bottom plan view of the shoe shown in FIG. 1 illustrating a portion of the fasteners upon the undersurface of the heel portion of the shoe.

In the illustrative embodiment there is mounted upon the undersurface or heel portion 35 of the sole a heel anchor plate 37 which is circular, FIG. 5, which includes a series of spaced vertically displaced arcuate lock segments 39 which are directed outwardly and are coplanar.

Figure 6:
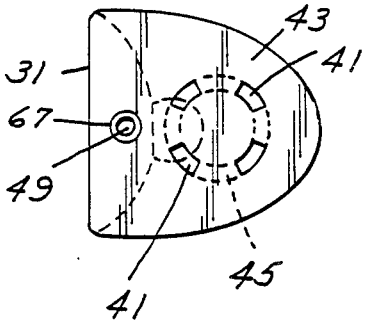
FIG. 6 is a top view of the removable replaceable heel, shown in FIG. 7, and in FIGS. 2, 3 and 4, upon a different scale, illustrative of the fastening mechanism thereon.
Figure 7:
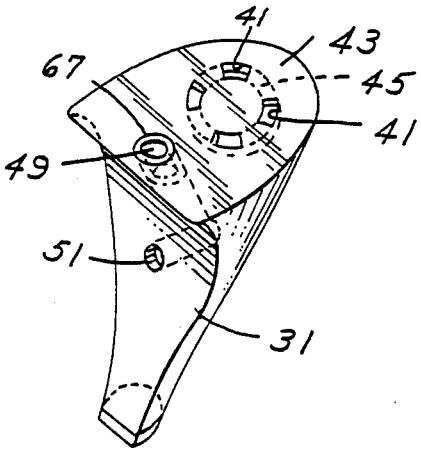
FIG. 7 is a front perspective view of the removable replaceable heel of FIGS. 2, 3 and 4.

Formed within the top end face 43 of heel 31, FIG. 6, are a series of correspondingly shaped and slightly oversized arcuate slots 41 arranged in a circle and adapted to receive segments 39 upon assembly of heel 31 with respect to the shoe.

In illustrative embodiment, formed within the top surface 43 of heel 31 and alternating with slots 41 are the undercut inwardly directed arcuate anchor flanges 45. Upon an angular positioning of the heel with respect to the heel portion 35 of the shoe, such as, for example 45° off its longitudinal axis, the corresponding lock segments 39 are projected into arcuate slots 41 and the heel rotated back approximately 45°, for illustration, until there is a firm interlock between the corresponding segments and flanges. The corresponding lock segments and flanges are interdigitated and interlocked together for firmly anchoring the heel 31 or 33 to heel portion 35 of shoe 11.

It is contemplated as equivalent that the arcuate lock segments 39 could be mounted upon the heel projecting upwardly thereof and the corresponding arcuate slots 41 and anchor flanges 45 mounted upon the undersurface of the sole of the shoe to obtain the identical interlock.

With the heel rotatively positioned so as to be in longitudinal alignment with the longitudinal axis of the shoe sole and the corresponding shank 19, the interlock between the heel and the shoe is maintained. For this purpose, there is provided an alignment opening 47 upon the undersurface heel portion 35 of the shoe and spaced from segments 39, FIG. 5.

Figure 3:
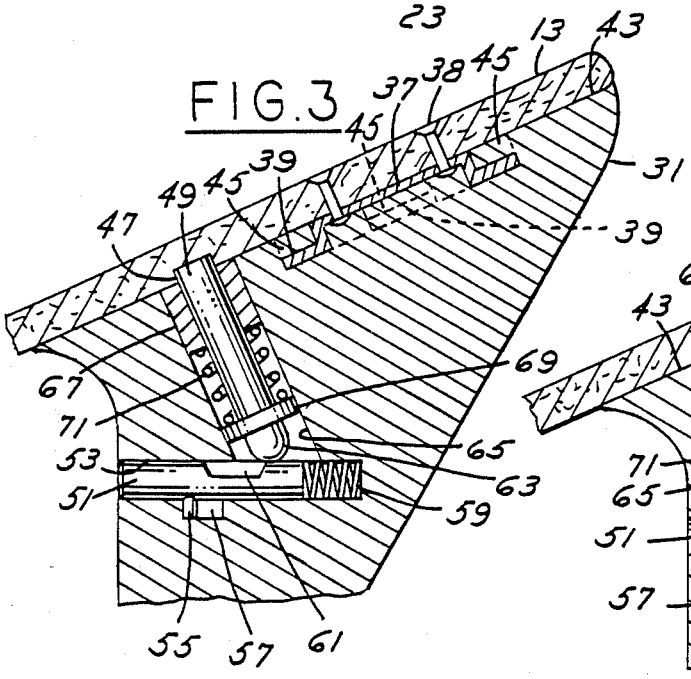
FIG. 3 is a fragmentary section taken in the direction of arrows 3—3 of FIG. 1, on an increased scale illustrating the removable attachment of the heel to the shoe, fragmentarily shown, and with the heel locked in position against rotation and disengagement.
Figure 4:
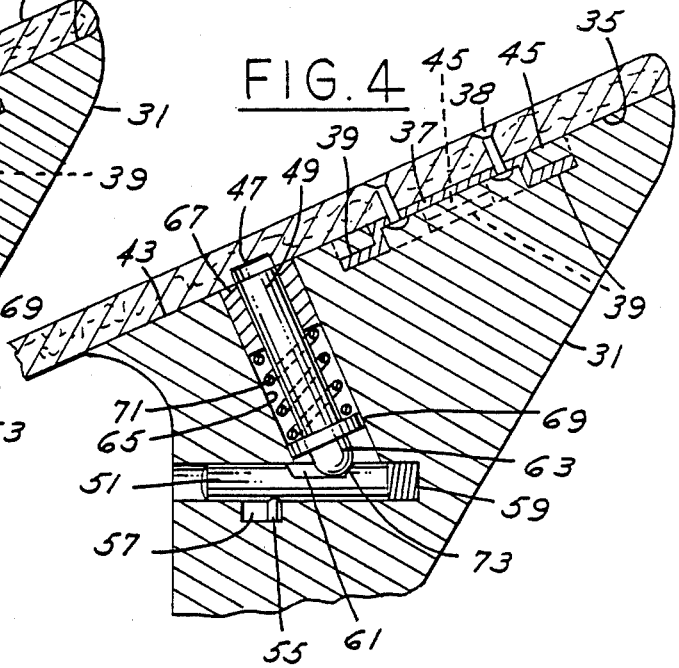
FIG. 4 is a similar view with the heel unlocked.

Positioned within heel 31, FIGS. 3 and 4, is an alignment or lock pin 49 which is retained within the heel 31 or 33 and in the locked position is projected up into the alignment opening 47, FIG. 3. As long as the alignment or lock pin 49 is in the lock position shown in FIG. 3, heel 31 may not rotate with respect to the sole and the interlock between the heel and shoe is maintained.

In order to retain the alignment pin 49 in the locked position shown in FIG. 3, there is provided an anchor pin 51 which is slidably nested within bore 53 within the heel. The pin 51 includes a depending pin stop 55 positionable wihtin slot 57. Coil compression spring or second spring means 59 within bore 53 normally urges anchor pin 51 outwardly of the heel to the lock position shown in FIG. 3. In this position, the anchor pin 51 operatively and retainingly engages the rounded end 63 of alignment pin 47, maintaining the alignment pin in the lock position shown in FIG. 3.

Formed within heels 31 and 33, FIGS. 3 and 4, is a bore 65 which is arranged at an acute angle to the axis of and intersects the corresponding axis of anchor pin 51. Sleeve 67 is retained within an outer portion of bore 65 and guidably receives alignment pin 49.

Secured adjacent the rounded end 63 of pin 49 is a collar 69. Coil compression spring or first spring means 71 surrounds alignment pin 49 and is interposed between sleeve 67 and collar 69 normally biasing alignment pin 49 outwardly to the unlocked position shown in FIG. 4. This is possible when the anchor pin 51 has been manually pressed inwardly so that its clearance recess 61 receives the rounded end 63 of the alignment pin 49.

Since the alignment pin is spring biased outwardly, the alignment pin 49 will automatically retract to the position shown in FIG. 4, once the anchor pin 51 has been manually retracted, and wherein the corresponding stop 55 engages the opposite end of slot 57.

In order to return the alignment pin 49 from the position shown in FIG. 4 to the position shown in FIG. 3, it is necessary to first retract lock pin 51. The rearward end of recess 61 defines a cam surface 73 so that upon inward projection of pin 51, as by utilizing the stop 55, and utilizing compression spring 59, the alignment pin 49 when centrally positioned relative to the shoe will return to registry within alignment opening 47 within the shoe sole.

While the alignment pin 49 is shown as spring biased outwardly, it is contemplated that the alignment pin 47 could be spring biased inwardly so as to automatically return to the interlocked position shown in FIG. 3, once the alignment pin 49 has been rotated into registry with alignment opening 47. This means that some other means be employed for retracting the alignment pin 49 when it is desired to rotate the heel 31, such sufficient angular position as will disengage the interlocking segments and flanges, FIGS. 5 and 6.

In the illustrative embodiment there is shown the lock pin or anchor pin 51 which provides a means for normally retaining the alignment pin 49 in the lock position shown. Since alignment pin 49 is spring biased outwardly, just as soon as the anchor pin 51 has been retracted, the alignment pin 49 will automatically be retracted to the position shown in FIG. 4 to permit relative rotation of the heel with respect to the heel portion of the shoe.

In the present construction, when this has occurred and the high heel 31 has been separated from the heel portion of the shoe, a low heel 33, FIG. 2, may replace the high heel and be reassembled in the same manner and interlocked with the heel portion 35 and again rotated back to the alignment position shown in FIG. 3. The fastening construction shown in FIG. 6 for heel 31 is the same for heel 33.

Since heel 33 is reduced in height, when changing heels to the low heel as shown in dash lines, FIG. 2, there is a modification of the center distance between the shank anchoring rivet 51 and the end of slot 17. This means that there will be some relative longitudinal movement of shank 19 within slot 17, which is permitted due to the extension 23 of the slot, FIG. 2. Thus, the flexible shank 19 for the shoe will accommodate heels of different height and at the same time provide a suitable support for the heel and insole but is relatively movable therewith upon change of the height of the respective heel.

It is contemplated as a part of the present invention that the heels 31 and 33 could also be replaced with heels of different colors as would be desired by the user for any reason such as matching different colors of dresses or costumes. In such case, any replacement would have similar fastening means as above described.

Having described my invention, reference should now be had to the following claims.

I claim:

1. A women's shoe for use with replaceable heels of different height comprising:

an elongated sole having a forward support portion and a raised heel portion;

an insole superimposed over and secured to the sole;

there being an elongated undercut central slot in said insole adjacent said sole;

an elongated flexible spring steel shank nested within said slot, at one end anchored to said sole and insole;

a high heel registrable with said heel portion;

interlocking fastener means upon said heel and heel portion removably anchoring said heel to said heel portion;

said high heel upon disengagement of said fastener means adapted for removal and replacement by a low heel having similar fastener means;

the replacement of the low heel shortening the distance between the anchoring of said shank and the end of said slot, with said shank moving longitudinally of said sole and insole within said slot.

2. In the women's shoe of claim 1, said shank being shorter than said slot.

3. In the women's shoe of claim 1, said shank having a heel end which is secured to said sole and insole.

4. In the women's shoe of claim 1, each heel having an end face, said interlocking fastener means including a plurality of interconnected spaced lock segments and spaced undercut lock flanges upon said heel portion and end face respectively, adapted upon relative rotation from locked position through an acute angle for disengagement;

and a retractible alignment pin in said heel spaced from said lock segments nested within an alignment opening in said sole preventing said relative rotation.

5. In the women's shoe of claim 4, said lock segments being mounted upon and secured to said heel portion and spaced therefrom with said lock flanges upon said heel;

in one angular position of said heel relative to said heel portion said segments being adapted for projection into corresponding slots in said heel, and upon relative angular rotation adapted to interlock with said flanges.

6. In the women's shoe of claim 4, said lock segments, flanges and slots being arcuate.

7. In the women's shoe of claim 5, the mounting of said lock segments including a heel anchor plate secured to said heel portion;

said lock segments depending from said anchor plate and projecting outwardly.

8. In the women's shoe of claim 4, a retractible anchor pin slidably mounted within said heel in a lock position retainingly engaging said alignment pin in heel locking position.

9. In the women's shoe of claim 8, spring means normally biasing said alignment pin toward a release position;

there being a clearance recess in said anchor pin, on manual retraction of said anchor pin said alignment pin moving into said recess.

10. In the women's shoe of claim 9, spring means normally biasing said anchor pin to locked position.

11. In the women's shoe of claim 10, and a stop pin on said anchor pin movable within a slot limiting outward positioning of said anchor pin.

12. In the women's shoe of claim 11, said anchor pin having a cam surface adjacent its recess, outward projection of said anchor pin adapted for camming said alignment pin into said alignment opening.

13. In the women's shoe for use with replaceable heels of different height comprising:

an elongated sole having a forward support portion and a raised heel portion;

an insole superimposed over and secured to the sole;

there being an elongated undercut central slot in said insole adjacent said sole;

an elongated flexible shank nested within said slot, at one end anchored to said sole and insole;

a high heel registrable with said heel portion;

interlocking fastener means upon said high heel and heel portion removably anchoring said high heel to said heel portion;

said high heel upon disengagement of said fastener means adapted for removal and replacement by a low heel having similar fastener means;

each high heel and low heel having an end face;

said interlocking fastener means including a plurality of interconnected spaced lock segments and spaced undercut lock flanges upon said heel portion and end face respectively, adapted upon relative rotation from locked position through an acute angle for disengagement; and a retractable alignment pin in each of said high heel and low heel which, when in use, is spaced from said lock segments nested within an alignment opening in said sole preventing said relative rotation;

said lock segments being mounted upon and secured to said heel portion and spaced therefrom with said lock flanges upon the opposing heel;

in one angular position of said opposing heel relative to said heel portion said segments being adapted for projection into corresponding slots in said opposing heel, and upon relative angular rotation adapted to interlock with said flanges.

the mounting of said lock segments including a heel anchor plate secured to said heel portion;

said lock segments depending from said anchor plate and projecting outwardly;

a retractable anchor pin slidably mounted within said heel in a lock position retainingly engaging said alignment pin in heel locking position; and the replacement of the low heel shortening the distance between the anchoring of said shank and the end of said slot, with said shank moving longitudinally in said sole and insole within said slot.

14. In a women's shoe for use with replaceable heels of different height comprising:

an elongated sole having a forward support portion and a raised heel portion;

an insole superimposed over and secured to the sole;

a high heel registrable with said heel portion;

interlocking fastener means upon said high heel and heel portion removably anchoring said high heel to said heel portion;

said high heel upon disengagement of said fastener means adapted for removal and replacement by a low heel having similar fastener means;

each heel having an end face;

said interlocking fastener means including a plurality of interconnected spaced lock segments and spaced undercut lock flanges upon said heel portion and end face of the opposing heel respectively, adapted upon relative rotation from locked position through an acute angle for disengagement;

a retractable alignment pin in each heel, said alignment of the opposing heel being spaced from said lock segments nested within an alignment opening in said sole preventing said relative rotation;

said lock segments being mounted upon and secured to said heel portion and spaced therefrom with said lock flanges upon the opposing heel;

in one angular position of said opposing heel relative to said heel portion said segments being adapted for projection into corresponding slots in said opposing heel, and upon relative angular rotation adapted to interlock with said flanges;

the mounting of said lock segments including a heel anchor plate secured to said heel portion;

said lock segments depending from said anchor plate and projecting outwardly; and a retractable anchor pin slidably mounted within said opposing heel in a lock position retainingly engaging said alignment pin in heel locking position;

and first spring means in each of said high heel and low heel, the first spring means of the opposing heel normally biasing said alignment pin toward a release position;

there being a clearance recess in said anchor pin, on manual retraction of said anchor pin said alignment pin moving into said recess.

15. In the women's shoe of claim 14 and second spring means in each of said high heel and low heel, the second spring means of the opposing heel normally biasing said anchor pin to an unlocked position.

16. A women's shoe for use with replaceable heels of different height comprising:

an elongated sole having a forward support portion and a raised heel portion;

an insole superimposed over and secured to the sole;

there being an elongated undercut central slot in said insole adjacent said sole;

an elongated flexible shank nested within said slot, at one end anchored to said sole and insole;

a high heel registrable with said heel portion;

interlocking fastener means upon said heel and heel portion removably anchoring said heel to said heel portion;

said high heel upon disengagement of said fastener means adapted for removal and replacement by a low heel having similar fastener means;

the replacement of the low heel shortening the distance between the anchoring of said shank and the end of said slot, with said shank moving longitudinally of said sole and insole within said slot.

* * * * *